US012053031B2

(12) United States Patent
Yang et al.

(10) Patent No.: US 12,053,031 B2
(45) Date of Patent: Aug. 6, 2024

(54) ATOMIZER, HOUSING THEREFOR AND ELECTRONIC ATOMIZING APPARATUS

(71) Applicant: Shenzhen Smoore Technology Limited, Guandong (CN)

(72) Inventors: Jiyong Yang, Guandong (CN); Kui Li, Guandong (CN)

(73) Assignee: Shenzhen Smoore Technology Limited, Shenzhen (CN)

( * ) Notice: Subject to any disclaimer, the term of this patent is extended or adjusted under 35 U.S.C. 154(b) by 678 days.

(21) Appl. No.: 16/680,501

(22) Filed: Nov. 12, 2019

(65) Prior Publication Data

US 2020/0163390 A1 May 28, 2020

(30) Foreign Application Priority Data

Nov. 22, 2018 (CN) ..... 201811400517.4

(51) Int. Cl.
*A24F 7/00* (2006.01)

(52) U.S. Cl.
CPC ..... *A24F 7/00* (2013.01)

(58) Field of Classification Search
None
See application file for complete search history.

(56) References Cited

U.S. PATENT DOCUMENTS

2003/0132507 A1* 7/2003 Odaira ..... H01H 13/702 257/620
2011/0223389 A1 9/2011 Lin et al.
2016/0143365 A1 5/2016 Liu
2016/0309787 A1 10/2016 Hawes et al.
2016/0366941 A1* 12/2016 Lin ..... F16B 21/06
2017/0105448 A1* 4/2017 Scarpulla ..... B65D 41/20
2017/0273359 A1 9/2017 Liu
2018/0338533 A1* 11/2018 Song ..... A61M 15/06
2019/0037929 A1* 2/2019 Furudono ..... A61M 11/042

FOREIGN PATENT DOCUMENTS

CN 101486243 A 7/2009
CN 202932038 U * 5/2013
CN 203341009 U 12/2013
CN 204070516 U 1/2015
CN 204070572 U 1/2015
CN 104366698 A 2/2015
(Continued)

OTHER PUBLICATIONS

English translation of CN 202932038 U (Year: 2013).*
(Continued)

*Primary Examiner* — Katherine A Will

(57) ABSTRACT

An atomizer may include a housing and an atomizing assembly. The housing may include a nozzle and a liquid storage pipe. The nozzle may be located at an end of the liquid storage pipe and integrated with the liquid storage pipe. At least a portion of an outer surface of the nozzle away from the liquid storage pipe may include a matte surface having a first rugosity. At least a portion of an outer surface of the housing may be a polished surface through which aerosol-generating substrate stored in the liquid storage pipe can be observed. The atomizing assembly may be configured to heat and atomize the aerosol-generating substrate to generate smoke.

16 Claims, 8 Drawing Sheets

(56) References Cited

FOREIGN PATENT DOCUMENTS

| | | | |
|---|---|---|---|
| CN | 204217908 | U | 3/2015 |
| CN | 204653781 | U | 9/2015 |
| CN | 106136322 | A | 11/2016 |
| CN | 107972226 | A | 5/2018 |
| CN | 207306072 | U | 5/2018 |
| CN | 207444270 | U | 6/2018 |
| CN | 108296140 | A | 7/2018 |
| DE | 3712128 | A1 | 10/1988 |
| EP | 3053459 | A2 | 8/2016 |
| EP | 3363309 | A2 | 8/2018 |
| JP | 2002096362 | A | 4/2002 |
| KR | 20120074625 | A | 7/2012 |
| WO | WO2016033741 | A1 | 3/2016 |
| WO | WO2016082180 | A1 | 6/2016 |
| WO | WO2017163213 | A1 | 9/2017 |

OTHER PUBLICATIONS

European search report and Written Opinion for related European application No. 19210079.0, mailed Apr. 17, 2020 (5 pages).
Chinese Second Office Action, Chinese application No. 201811400517.4, mailed Jul. 23, 2021 (17 pages).
Chinese First office action, Chinese application No. 201811400517.4, mailed Dec. 25, 2020 (10 pages).
Notification to Grant Patent Right for Invention, Chinese application No. 201811400517.4, mailed Jan. 14, 2022 (6 pages).
Nicocig Mesh starter kit review, https://www.ecigsadvice.co.uk/nicocig-mesh-starter-kit-review!, publication date: Feb. 26, 2017.
What does the future of tobacco look like, https://www.cspdailynews.com/tobacco/what-does-future-tobacco-look#page=2, publication date: Jun. 9, 2017.
Philip Morris Interational seeks PR support for smoke-free push, https://www.provokemedia.com/latest/article/philip-morris-international-seeks-pr-support-for-smoke-free-push, publication date: Jul. 12, 2018.
The Importance of offering Adult Smokers a Portfolio of Potentially Less Harmful Products, https://www.pmiscience.com/library/publication/the-importance-of-offering-adult-smokers-a-portfolio-of-potentially-less-harmful-products, publication date: Jun. 16, 2017.
IQOS Mesh Vape Pen VS. Nicocig E-Cigarettes, https://www.healthandcare.co.uk/blog/iqos-mesh-vape-pen-vs-nicocig-e-cigarettes.html, publication date: Nov. 21, 2018.
Plastics Today: By Design-Part Design 1019-Textured Dinishes, https://www.plasticstoday.com/design-part-design-109-textured-finishes, publication date: May 29, 2020.
Injection Moulding Handbook 3d Ed; Editors Rosato, 2000Rosato, Rosato (Springer Science + Business MediaLLC), published in year 2000.
Communication of a notice of opposition, European application No. 19210079.0, mailed Mar. 8, 2022.

* cited by examiner

ATOMIZER, HOUSING THEREFOR AND ELECTRONIC ATOMIZING APPARATUS

CROSS REFERENCE TO RELATED APPLICATIONS

The present application claims foreign priority of Chinese Patent Application No. 201811400517.4, filed on Nov. 22, 2018, in the China National Intellectual Property Administration, the entire contents of which are hereby incorporated by reference in their entireties.

TECHNICAL FIELD

The present disclosure relates to electronic atomizing devices, and in particular to an atomizer, a housing of an atomizer and an electronic atomizing apparatus with an atomizer.

BACKGROUND

Electronic atomizing devices can be used as replacement of cigarettes and are often used for smoking cessation. Electronic atomizing devices normally do not have tar, floating micro particles or other harmful ingredients compared to cigarettes.

The housing of a traditional electronic atomizing device has to be made of different materials to acquire different light transmittances, which involves complex manufacturing processes and methods. Thus, the cost for the electronic atomizing device is high, and the productivity is low.

SUMMARY

According to an aspect of the present disclosure, an atomizer may be provided. The atomizer may include a housing and an atomizing assembly. The housing may include a nozzle and a liquid storage pipe, the nozzle may be located at an end of the liquid storage pipe and integrated with the liquid storage pipe, at least a portion of an outer surface of the nozzle away from the liquid storage pipe may include a matte surface having a first rugosity, at least a portion of an outer surface of the housing may be a polished surface through which aerosol-generating substrate in the liquid storage pipe is observed. The atomizing assembly may be configured to heat and atomize the aerosol-generating substrate to generate aerosol.

According to another aspect of the present disclosure, a housing may be provided. The housing may be adapted for an atomizer. The housing may include a side wall and an end wall connected to the side wall. A chamber, configured to receive an atomizing assembly of the atomizer and store aerosol-generating substrate, may be defined by the side wall and the end wall. A gas exiting hole may be defined in the end wall. A portion of an outer surface of the side wall, which is adjacent to the end wall and configured to contact with user when being used, may include a first matte surface. The other portion of the outer surface of the side wall may include a polished surface through which aerosol-generating substrate in the chamber is observed.

According to another aspect of the present disclosure, an electronic atomizing apparatus may be provided. The electronic atomizing apparatus may include an atomizer and a battery assembly. The atomizer may include a housing and an atomizing assembly. The housing may include a nozzle and a liquid storage pipe, the nozzle may be located at an end of the liquid storage pipe and integrated with the liquid storage pipe, at least a portion of an outer surface of the nozzle away from the liquid storage pipe may include a matte surface having a first rugosity, at least a portion of an outer surface of the housing may be a polished surface through which aerosol-generating substrate in the liquid storage pipe is observed. The atomizing assembly may be configured to heat and atomize the aerosol-generating substrate to generate aerosol. The battery assembly may be connected to the liquid storage pipe and configured to power the atomizer.

BRIEF DESCRIPTION OF THE DRAWINGS

In order to clearly explain the technical solutions in the embodiments of the present disclosure, the drawings used in the description of the embodiments will be briefly described below. Obviously, the drawings in the following description are merely some embodiments of the present disclosure. For those of ordinary skill in the art, other drawings may also be obtained based on these drawings without any creative work.

DETAILED DESCRIPTION

The disclosure will now be described in detail with reference to the accompanying drawings and examples. Apparently, the described embodiments are only a part of the embodiments of the present disclosure, not all of the embodiments. All other embodiments obtained by a person of ordinary skill in the art based on the embodiments of the present invention without creative efforts shall fall within the protection scope of the present invention.

Figure 1:
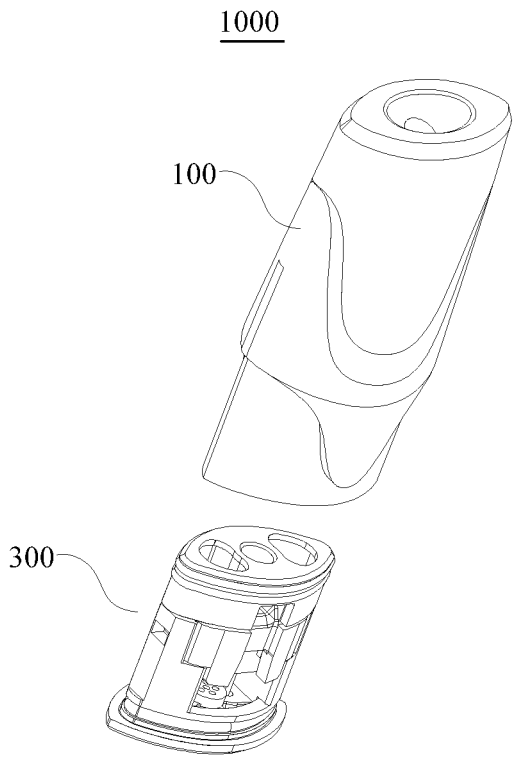
FIG. 1 is an exploded view of an atomizer according to some embodiments of the present disclosure.

FIG. 1 is an exploded view of an atomizer according to some embodiments of the present disclosure. In some embodiments, an atomizer 1000 is provided. The atomizer 1000 may include a housing 100 and an atomizing assembly 300. Aerosol-generating substrate may be stored inside the housing 100. The atomizing assembly 300 may be configured to heat and atomize the aerosol-generating substrate to generate aerosol.

In some embodiments, the atomizing assembly 300 may be arranged outside the housing 100. The aerosol-generating substrate stored inside the housing 100 may be transported to the atomizing assembly 300 through a liquid guiding component. The atomizing assembly 300 may then atomize the aerosol-generating substrate into aerosol.

In some embodiments, the atomizing assembly 300 may be arranged inside the housing 100. Thus, the atomizing assembly 300 may contact directly the aerosol-generating substrate, which makes the structure of the atomizer 1000 more compact and less voluminous.

Figure 2:
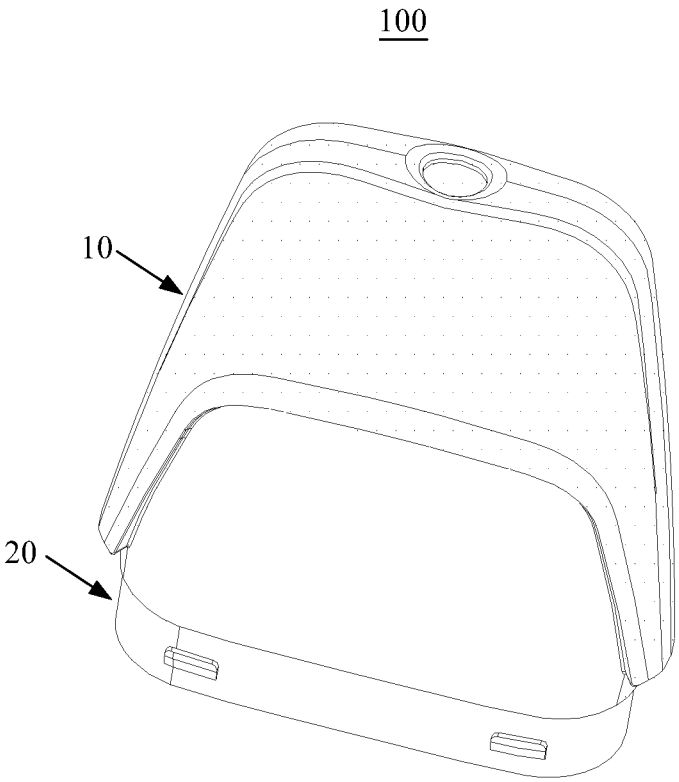
FIG. 2 is an isometric view of a housing according to some embodiments of the present disclosure.

Referring to FIG. 2, the housing 100 may include a nozzle 10 and a liquid storage pipe 20. The nozzle 10 may be located at an end of the liquid storage pipe 20 and integrated with the liquid storage pipe 20. That is, the nozzle 10 and the liquid storage pipe 20 may be formed of a single piece. The liquid storage pipe 20 may be utilized for installation of the atomizing assembly 300 and for storing aerosol-generating substrate. The atomizing assembly 300 may generate heat to heat the aerosol-generating substrate and transform the aerosol-generating substrate into aerosol. A smoker may inhale the aerosol generated by the atomizing assembly 300 through the nozzle 10.

In some embodiments, the nozzle 10 may define an accommodation cavity inside. The accommodation cavity may be in fluid communicate with a reservoir of the liquid storage pipe 20 which is utilized to store aerosol-generating substrate. Therefore, aerosol-generating substrate may also be stored inside the nozzle 10, and the liquid storage capacity of the atomizer 1000 may be increased. Apparently, the nozzle 10 is not limited thereto and may alternatively be not for storing aerosol-generating substrate.

The housing 100 may be made of translucent material such that a service condition of the aerosol-generating substrate inside the liquid storage pipe 20 may be observed through the housing 100.

Since plastic products made of PCTG (an amorphous polyester) has several advantages such as high transparency, high chemical corrosion resistance and high shock proof, PCTG is widely used in packing industry, such as cosmetic containers, dust containers of vacuum cleaners, solution barrels of cleaning machines, etc.

In some embodiments, the housing 100 may be made of PCTG such that the housing 100 may have high transparency for facilitating observation. Moreover, potential chemical reaction between the material of the housing 100 and the aerosol-generating substrate stored in the liquid storage pipe 20 which may generate harmful matters can be avoided. Furthermore, the electronic atomizer 100 may be prevented from being damaged under external impact.

The color of the housing 100 may vary in different embodiments, e.g., red, golden, grey, brown, or the housing 100 may have more than one colors.

In some embodiments, color powders may be added in PCTG such that the color powders may be evenly mixed in injection material and the formed housing 100 may have uniform color. By forming the housing 100 with a certain color, the appearance of the electronic atomizer 1000 may be improved.

In some embodiments, at least a portion of the outer surface of the nozzle 10 away from the liquid storage pipe 20 may be a matte surface having a first rugosity. By setting this portion of the outer surface of the nozzle 10 away from the liquid storage pipe 20 as a matte surface, on one hand, the concern of the user that the aerosol-generating substrate in the translucent nozzle 10 seems to lean to his or her mouth can be released (in fact, the aerosol-generating substrate does not enter the user's mouth), and on the other hand, lip or saliva prints can be prevented from occurring on the outer surface of the nozzle 10 during utilization, which may improve the user's experience.

In some embodiments, the light transmittance of the matte surface having a first rugosity may be from 10% to 80% such as 10%, 20%, 30%, 40%, 50%, 60%, 70% or 80%. In other embodiments, it can be flexibly selected based on actual requirements. The light transmittance of the matte surface may be achieved by at least one of: (1) controlling the surface rugosity of the matte surface; and (2) controlling the color or component proportion of the color powders in the modeling materials.

In some embodiments, at least a portion of the outer surface of the housing 100 may be a polished surface. An observing window may be formed by the polished surface such that a user may easily observe the use condition of the aerosol-generating substrate inside the housing 100 through the observing window. Therefore, it can be avoided that the atomizer is dry and burned after the aerosol-generating substrate is used up. Burning may generate burnt smell and damage the atomizer.

The light transmittance of the polished surface may be from 30% to 100%, such as 30%, 40%, 50%, 60%, 70%, 80%, 90% or 100%, which may facilitate the observation of use condition of the aerosol-generating substrate inside the housing 100. The light transmittance of the polished surface may be achieved by at least one of: (1) controlling the thickness of the wall of the housing 100 corresponding to the location of the polished surface; and (2) controlling the color or the component proportion of color powders in the modeling materials. For instance, the portion of the housing 100 corresponding to the polished surface may be thinner than the portion corresponding to the matte surface so that the polished surface may have a higher light transmittance and have better light transmission.

It should be understood, the light transmittance of the polished surface should be larger than the light transmittance of the matte surface in a same housing 100. That is, for a same housing 100, if the light transmittance of the matte surface is equal to 30%, the light transmittance of the polished surface should be larger than 30% (e.g., the light transmittance of the polished surface may be equal to 40%, 60%, or 100%).

In the embodiment shown in FIG. 2, the entire outer surface of the nozzle 10 may be a matte surface having the first rugosity. Meanwhile, the entire outer surface of the liquid storage pipe 20 may be a polished surface such that the observing window may be enlarged for facilitating observation.

Figure 3:
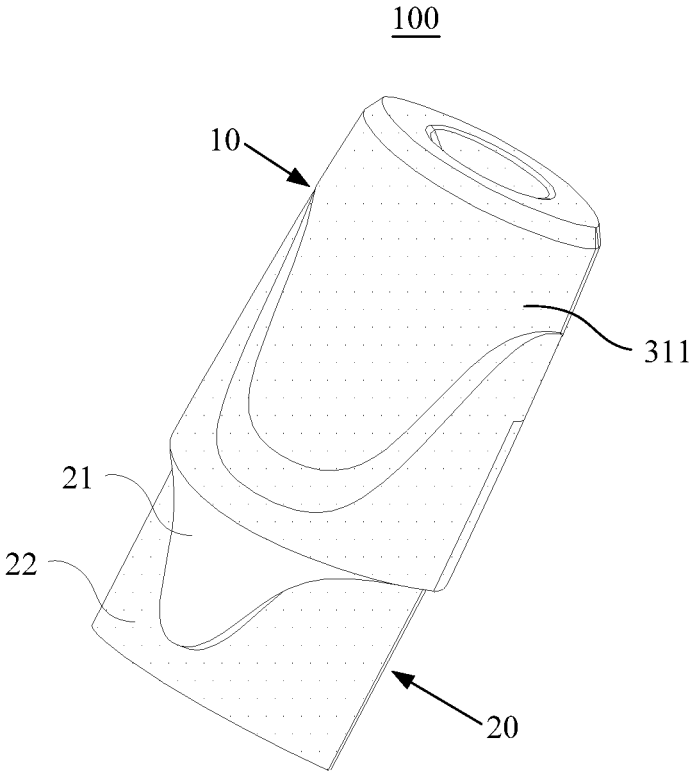
FIG. 3 is an isometric view of a housing according to some embodiments of the present disclosure.

In another embodiment shown in FIG. 3, the outer surface of the liquid storage pipe 20 may include a first surface 21 and a second surface 22. The first surface 21 may be arranged between the outer surface of the nozzle 10 and the second surface 22. The first surface 21 may be set as a polished surface, and the second surface 22 may be set as a matte surface having a second rugosity.

The second rugosity of the second surface 22 may be same as or different from the first rugosity of the outer surface of the nozzle 10. Surface rugosities may be selected based on actual design requirements such as light transmittance requirements, which is not limited in the present disclosure.

Referring to FIG. 3, in this embodiment, the outer surface of the liquid storage pipe 20 may include a first surface 21 and a second surface 22. The first surface 21 is a polished surface, and thereby the use condition of the aerosol-generating substrate inside the liquid storage pipe 20 may be observed through the first surface 21. The second surface 22 is a matte surface. By setting the second surface 22 as a matte surface, on one hand, a user may not leave his or her fingerprint on the housing 100 when changing aerosol-generating substrate, on the other hand, surface scratches on the housing 100 can be avoided.

In some embodiments, the first rugosity may be substantially equal to the second rugosity. That is, the surface rugosity of the second surface 22 may be substantially equal to the surface rugosity of the outer surface of the nozzle 10, which may reduce the manufacturing complexity of the forming die of the housing 100.

In some embodiments, the outer surface of the liquid storage pipe 20 may further include a third surface. The third surface may be arranged on a side of the second surface 22 away from the first surface 21. The third surface may similarly be either a polished surface or a matte surface.

Figure 4:
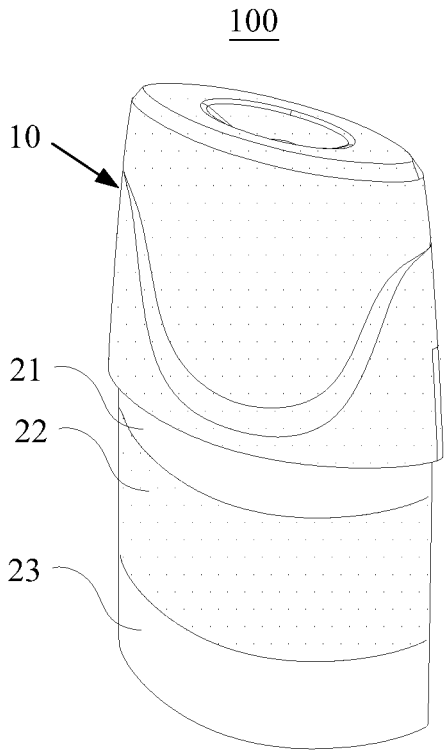
FIG. 4 is an isometric view of a housing according to some embodiments of the present disclosure.

Referring to FIG. 4, in some embodiments, the outer surface of the liquid storage pipe 20 may include a first surface 21, a second surface 22 and a third surface 23. The first surface 21 may be a polished surface, the second surface 22 may be a matte surface, and the third surface 23 may be a polished surface. Setting the third surface 23 as a polished surface may facilitate the assembling of the liquid storage pipe 20 with other components of the electronic atomizer.

In all the embodiments shown in FIGS. 2 to 4, the outer surface of the nozzle 10 is a matte surface having a first rugosity, and at least a portion of the outer surface of the liquid storage pipe 20 is a polished surface. Apparently, in other embodiments, a portion of the nozzle 10 may alternatively be arranged with a polished surface such that the use condition of the aerosol-generating substrate inside the housing 100 may be observed through the polished surface of the nozzle 10.

Figure 5:
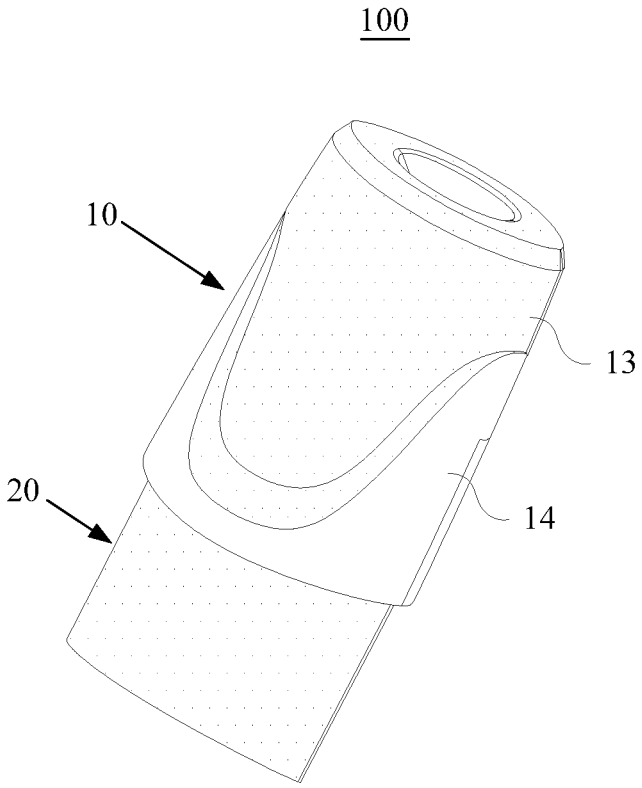
FIG. 5 is an isometric view of a housing according to some embodiments of the present disclosure.

Referring to FIG. 5, the outer surface of the nozzle 10 may further include a polished surface 14. The polished surface 14 may be located on at least one side of the matte surface 13. An end of the outer surface of the nozzle 10 away from the liquid storage pipe 20 may not be arranged with a polished surface, as shown in FIG. 5, the polished surface 14 of the nozzle 10 may be closer to the liquid storage pipe 20 than the matte surface 13 of the nozzle 10. Setting the nozzle 10 with a polished surface 14 may provide an easy and fast way to observe the aerosol-generating substrate inside the liquid storage pipe 20.

In one embodiment, as shown in FIG. 5, the polished surface 14 may be arranged around the matte surface 13, and an end of the outer surface of the nozzle 10 away from the liquid storage pipe 20 may not be arranged with a polished surface 14. Thus, the concern of the user that the aerosol-generating substrate in the translucent nozzle 10 seems to enter his or her mouth can be released (in fact, the aerosol-generating substrate does not enter the user's mouth). The polished surface 14 may be arranged on three sides of the matte surface 13 and around the matte surface 13 such that the observing window of the nozzle 10 may have a largest area to facilitate observation.

In other embodiments, the polished surface may be arranged on two opposite sides of the matte surface. That is, the nozzle 10 may include two main surfaces and two side surfaces located on two opposite sides of the two main surfaces. The main surfaces are the main contact surfaces between a user's lip and the nozzle 10 when the user uses the smoking device. Setting the main surfaces as a matte surface and setting the side surfaces as polished surfaces can not only allow observation of the aerosol-generating substrate in the housing through the side surfaces, but also enlarge area of the matte surface which can void lip print on the device.

In other embodiments, the polished surface may be set on only one side of the matte surface to maximize area of the matte surface.

Moreover, the polished surface and the matte surface on the outer surface of the nozzle 10 may be symmetric about the central plan of the nozzle 10.

In some embodiments, as shown in FIGS. 2 to 5, area of the cross-section of the nozzle 10 may gradually decrease in the direction away from the liquid storage pipe 20. In this way, a user may hold and use the nozzle 10 comfortably, which may improve user experience of smoking.

Further, the shape of the end of the nozzle 10 away from the liquid storage pipe 20 may be rectangular, oval, circular etc.

For example, in the embodiment shown in FIG. 2, the end of the nozzle 10 away from the liquid storage pipe 20 may have a rectangular configuration. In the embodiments shown in FIGS. 3-5, the end of the nozzle 10 away from the liquid storage pipe 20 may have an oval configuration.

By providing different options of shapes of the nozzle 10, a user may choose the nozzle 10 with a suitable shape based on the shape of his or her lip to acquire more comfortable use experience.

Figure 6:
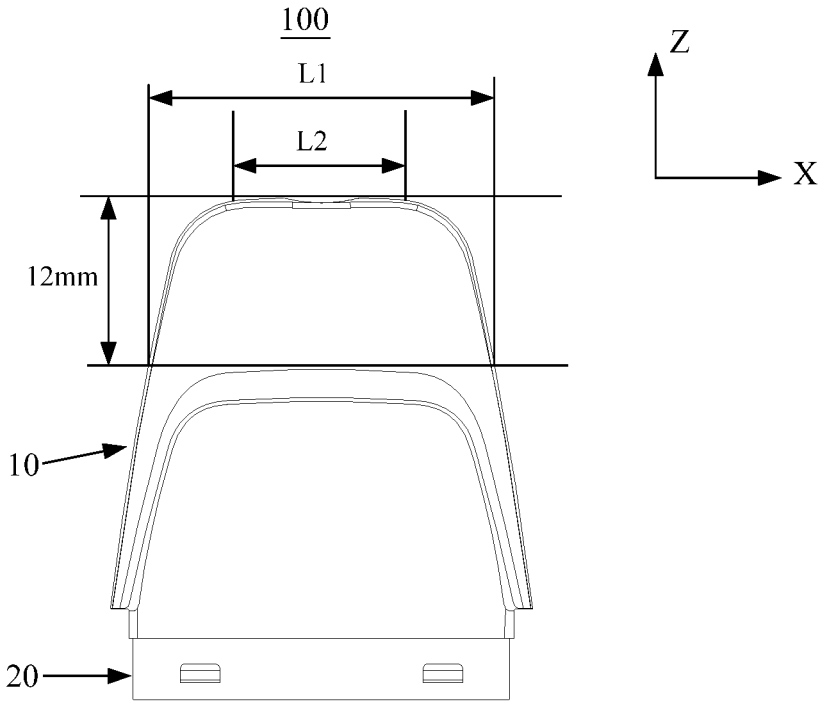
FIG. 6 is a front view of the housing shown in FIG. 2.
Figure 7:
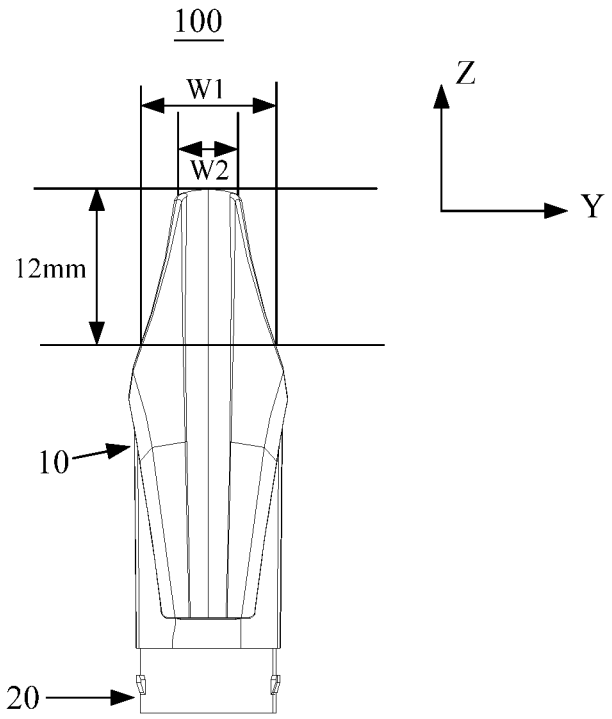
FIG. 7 is a side view of the housing shown in FIG. 2.

Referring to FIGS. 6 and 7, FIGS. 6 and 7 are respectively the front view and the side view of the nozzle 10 shown in FIG. 2.

Conventionally, when a user uses an electronic atomizer, the end of the nozzle 10 away from the liquid storage pipe 20 abuts the teeth of the user. According to researches, the distance between the end of the nozzle 10 away from the liquid storage pipe 20 and the portion of the nozzle 10 contacting the user's lip ranges usually from 10 to 15 mm, such as 10 mm, 12 mm, 14 mm, 15 mm etc. Accordingly, smoking experience of the nozzle 10 is related to the sizes of the end of the nozzle 10 away from the liquid storage pipe 20 and the sizes of the portion of the nozzle 10 located 10-15 mm from the end. In some embodiments, a predefined distance from the end of the nozzle 10 away from the liquid storage pope 10 may be 12 mm. In the following examples, the predefined distance of 12 mm will be used to explain in detail the shape and size of this portion of the nozzle 10.

Referring to FIGS. 6 and 7, since the area of the cross-section of the nozzle 10 gradually decreases in the direction away from the liquid storage pipe 20, in the portion from the end of the nozzle 10 away from the liquid storage pipe 20, to the position which is 12 mm from the end of the nozzle 10 away from the liquid storage pipe 20, the cross-section of the portion of the nozzle 10 at the position which is 12 mm from the end of the nozzle 10 away from the liquid storage pipe 20 is largest. At this location, a length of the nozzle 10 may range 17.1 to 26.1 mm in a first direction, and a width of the nozzle 10 may range from 8.1 to 11.3 mm in a second direction. The end of the nozzle 10 away from the liquid storage pipe 20 may have a smallest cross-section area. At this location, the length of the nozzle 10 may range from 8.8 to 18.2 mm in the first direction, and the width of the nozzle 10 may range from 4.4 to 7.7 mm in the second direction. The first and second directions are substantially perpendicular.

Specifically, the first direction may be taken as the length direction of the nozzle 10, and the second direction may be taken as the width direction of the nozzle 10. The largest sizes L1 and W1 of the nozzle 10 in the length and width directions are the length and width of the cross-section of the portion of the nozzle 10 which is located 12 mm from the end of the nozzle 10 away from the liquid storage pipe 20. The smallest sizes L2 and W2 of the nozzle 10 in the length and width directions are the length and width of the nozzle at the end surface of the end of the nozzle 10 away from the liquid storage pipe 20. In this embodiment, L1=17.1 to 26.1 mm, L2=8.8 to 18.2 mm, W1=8.1 to 11.3 mm, W2=4.4 to 7.7 mm.

Furthermore, the size of the nozzle 10 may be also relative to the shape of the end of the nozzle 10 away from the liquid storage pipe 20.

In the embodiments shown in FIGS. 6 and 7, the end of the nozzle 10 away from the liquid storage pipe 20 may have a rectangular configuration. At the portion of the nozzle 10 which is 12 mm from the end of the nozzle 10 away from the liquid storage pipe 20, the length of the nozzle 10 in the first direction (X direction) may range from 17.1 to 19 mm, and the width of the nozzle 10 in the second direction (Y direction) may range from 8.1 to 9 mm. At the end of the nozzle 10 away from the liquid storage pipe 20, the length of the nozzle 10 in the first direction (X direction) may range from 13 to 17 mm, and the width of the nozzle 10 in the second direction (Y direction) may range from 6 to 7 mm.

For example, in some embodiments, at the portion of the nozzle which is 12 mm from the end of the nozzle 10 away from the liquid storage pipe 20, the length of the nozzle 10 is 17.4 mm, and the width of the nozzle 10 is 8.1 mm. The length and the width of the nozzle at the end of the nozzle 10 away from the liquid storage pipe 20 are respectively 13.1 mm and 6.2 mm.

Figure 8:
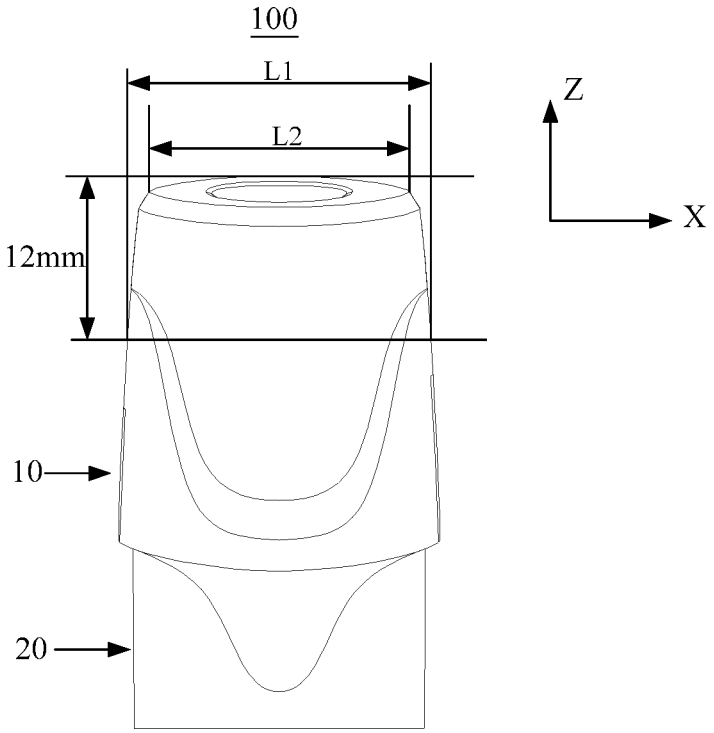
FIG. 8 is a front view of the housing shown in FIG. 3.
Figure 9:
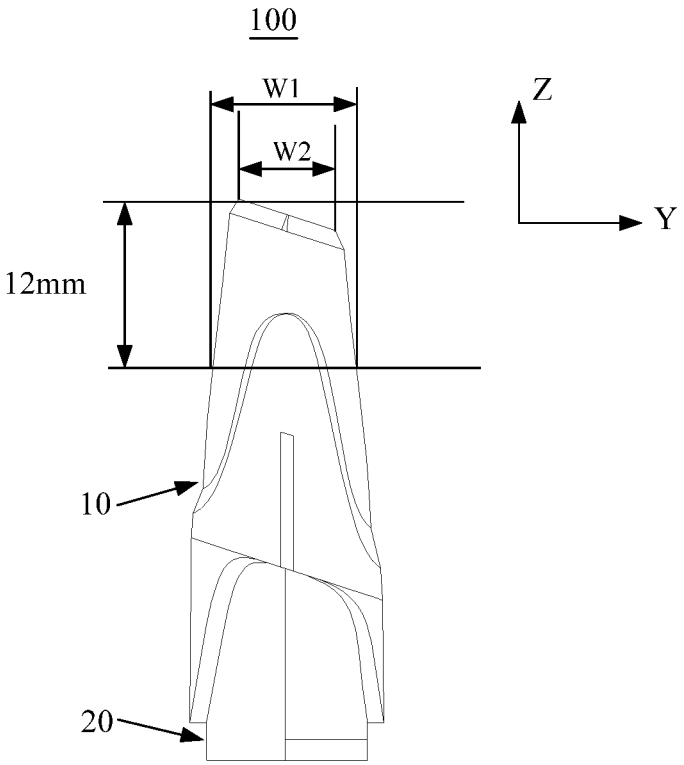
FIG. 9 is another side view of the housing shown in FIG. 3.

In the embodiments shown in FIGS. 8 and 9, the end of the nozzle 10 away from the liquid storage pipe 20 may have an oval configuration. At the portion of the nozzle 10 which is 12 mm from the end of the nozzle 10 away from the liquid storage pipe 20, the length of the nozzle 10 in the first direction (X direction) may range from 19 to 20 mm, and the width of the nozzle 10 in the second direction (Y direction) may range from 9 to 10.5 mm. At the end of the nozzle 10 away from the liquid storage pipe 20, the length of the nozzle 10 in the first direction (X direction) may range from 16.5 to 18.2 mm, and the width of the nozzle 10 in the second direction (Y direction) may range from 6.5 to 7.5 mm.

For example, in some embodiments, at the portion of the nozzle which is 12 mm from the end of the nozzle 10 away from the liquid storage pipe 20, the length of the nozzle 10 is 19.1 mm, and the width of the nozzle 10 is 10.4 mm. The length and the width of the nozzle at the end of the nozzle 10 away from the liquid storage pipe 20 are respectively 16.8 mm and 6.9 mm. Alternatively, in other embodiments, at the portion of the nozzle which is 12 mm from the end of the nozzle 10 away from the liquid storage pipe 20, the length of the nozzle 10 is 19.5 mm, and the width of the nozzle 10 is 9.0 mm. The length and the width of the nozzle at the end of the nozzle 10 away from the liquid storage pipe 20 are respectively 18.2 mm and 7.4 mm.

Figure 10:
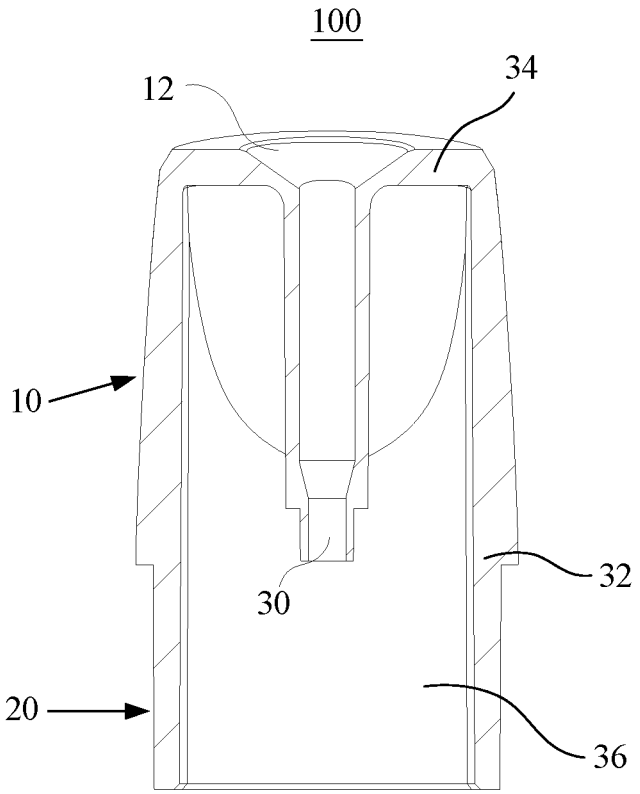
FIG. 10 is a cross-section view of the housing shown in FIG. 3.

Continuing to refer to FIG. 10, a surface of the nozzle 10 away from the liquid storage pipe 20 may define a gas exiting hole 12. The housing 100 may further include a gas exiting pipe 30. The gas exiting pipe 30 may be located inside the liquid storage pipe 20 and be connected to a fringe of the gas exiting hole 12. The gas exiting pipe 30 and the nozzle 10 may be formed of a single piece.

In some embodiments, the number of the gas exiting hole(s) 12 on the nozzle 10 may be one or more, which is not limited in the present embodiments. When there is one gas exiting hole 12, the single gas exiting hole 12 may be arranged at the center of the nozzle 10. When there are two gas exiting holes 12, the two gas exiting holes 12 may be symmetrically arranged on the nozzle 10 such that smoke may evenly exit from the gas exiting holes 12.

The gas exiting pipe 30 may be connected to the fringe of the gas exiting hole 12, and be integrated with the nozzle 10 and the liquid storage pipe 20. Thus, the housing 100 may be formed of in one single piece, which may simplify the manufacturing process and improve productivity.

Furthermore, the inner wall of the gas exiting pipe 30 may be coated with oleophobic material, in other words, an oleophobic layer may be provided on the inner wall of the gas exiting pipe 30, so as to prevent aerosol-generating substrate which has not been vaporized from exiting from the gas exiting pipe 30.

Since the gas exiting pipe 30 is located inside the liquid storage pipe 20 and may reach the aerosol-generating substrate in the liquid storage pipe 20, the aerosol-generating substrate may possibly flow out of the gas exiting hole 12 with the smoke, which may affect taste and smell. In this embodiment, by coating the inner wall of the gas exiting pipe 30 with oleophobic material, the aerosol-generating substrate will flow back to the liquid storage pipe 20 when flowing with smoke and attaching to the inner wall of the gas exiting pipe 30. Thus, leakage of the aerosol-generating substrate can be prevented.

Apparently, in other embodiments, an oil absorption device may be set in the gas exiting pipe 30 for removing aerosol-generating substrate from smoke, which may improve taste and smell.

In the embodiments shown in FIGS. 2 to 5, in the connection direction in which the nozzle 10 is connected to the liquid storage pipe 20 (Z direction as shown in FIG. 6), the largest size of the cross-section of the nozzle 10 perpendicular to the connection direction is larger than the largest size of the cross-section of the liquid storage pipe 20 perpendicular to the connection direction. In this implementation, the outer surface of the nozzle 10 may be flush with the outer surface of a battery assembly 4000 of the electronic atomizer when the liquid storage pipe 20 is connected to the battery assembly 4000, which may improve the appearance of the product.

It should be noted that, the term "integral structure" mentioned in the present disclosure refers to a structure made by one single piece of material and formed in a die within one forming process, and the structure does not include any other material. Furthermore, the outer surface of the nozzle 10 and the outer surface of the liquid storage pipe 20 are the outer surface (especially the side outer surface) of the housing 100. The inner surface of the housing 100 is an inner surface of a cavity which is configured to accommodate aerosol-generating substrate, and this inner surface can be a polished surface.

A housing 100 adapted for an atomizer may be further provided. As shown in FIG. 10, the housing 100 may include a side wall 32 and an end wall 34 connected to the side wall 32. A chamber 36 may be defined by the side wall 32 and the end wall 34. The chamber 36 may be configured to receive an atomizing assembly of the atomizer and store aerosol-generating substrate. A gas exiting hole 12 may be defined in the end wall 34. As shown in FIG. 3, a portion of an outer surface of the side wall 32, which is adjacent to the end wall 34 and configured to contact with user when being used, may include a first matte surface 311. The other portion of the outer surface of the side wall 32 may include a polished surface 21 through which aerosol-generating substrate in the chamber 36 could be observed.

In some embodiments, the other portion of the outer surface of the side wall 32 may further include a second matte surface 22. The polished surface 21 may be between the first matte surface 311 and the second matte surface 22 (as shown in FIG. 3).

Figure 11:
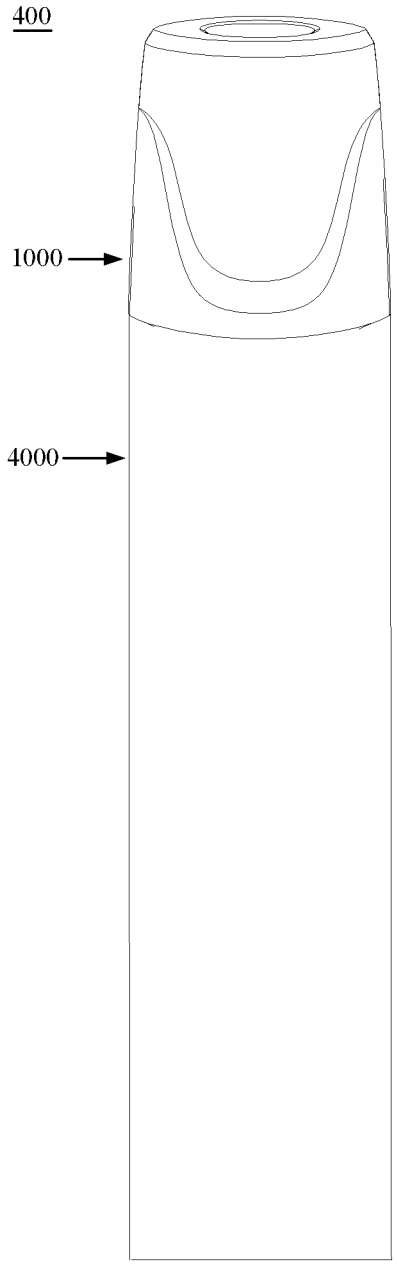
FIG. 11 is a schematic view of an electronic atomizing apparatus according to some embodiments of the present disclosure.

As shown in FIG. 11, the present disclosure may further provide an electronic atomizing apparatus 400. The electronic atomizing apparatus 400 may include an atomizer 1000 and a battery assembly 4000. The atomizer 1000 may be any one of embodiments mentioned above. The battery assembly 4000 may be connected to the liquid storage pipe 20 (as shown in FIGS. 3 to 10) and configured to power the atomizer 1000.

Figure 12:
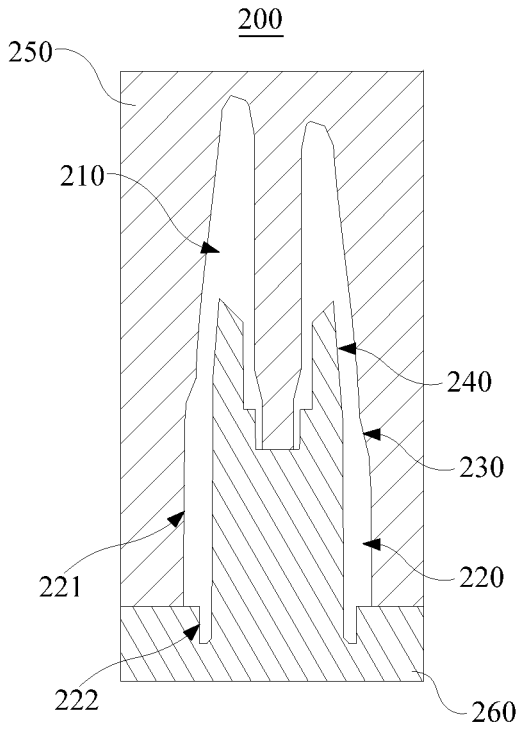
FIG. 12 is a cross-section view of a forming die according to some embodiments of the present disclosure.
Figure 13:
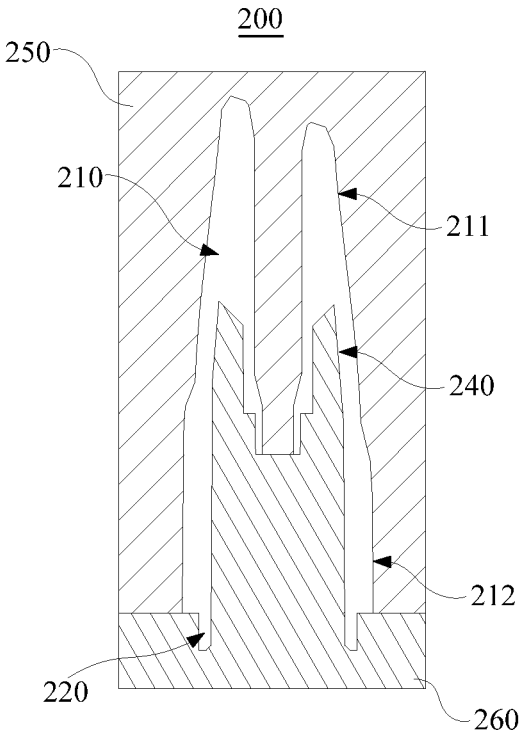
FIG. 13 is a cross-section view of a forming die according to some embodiments of the present disclosure.

As shown in FIG. 12, the present disclosure may further provide a forming die 200 for manufacturing the housing 100. The forming die 200 may be configured to manufacture the housing 100 described in the above embodiments by injection.

As shown in FIG. 12, the forming die 100 may define a first die cavity 210 configured to form the nozzle 10 of the housing 100 and a second die cavity 220 configured to form the liquid storage pipe 200 of the housing 100. The first die cavity 210 may communicate with the second die cavity 220. In some embodiment, the first die cavity 210 may communicate with the second die cavity 220 directly. The surface of a portion of an outer side wall of the first die cavity 210 away from the second die cavity may have a first rugosity such that a portion of the outer surface of the formed nozzle 10 away from the liquid storage pipe 20 formed by using the forming die comprises a matte surface may be a matte surface having the first rugosity. At least a portion of the outer side wall of the first die cavity 210 and the second die cavity 220 may include a polished surface such that at least a portion of the outer surface of the formed housing 100 may be a polished surface.

Referring also to FIGS. 2 to 4, the first die cavity 210 of the forming die 200 may be configured to form the nozzle 10, and the second die cavity 220 may be configured to form the liquid storage pipe 20. The outer side wall of the first die cavity 210 may all be a surface with the first rugosity, and at least a portion of the outer side wall of the second die cavity 220 may be a polished surface.

In some embodiments, the entire outer side wall of the second die cavity 220 may be a polished surface such that the entire outer surface of the liquid storage pipe 20 formed by injection with the second die cavity 220 may be a polished surface.

In other embodiments, as shown in FIG. 12, the outer side wall of the second die cavity 220 may include at least a first outer side surface 221 and a second outer surface 222. The first outer side surface 221 may be located between the second outer side surface 222 and the surface of the outer side wall of the first die cavity 210. The first outer surface 221 may be a polished surface such that the first surface 21 of the liquid storage pipe 20 of the formed housing 100 may be a polished surface. The second outer surface 22 may be a matte surface having a second rugosity such that the second surface 22 of the liquid storage pipe 20 of the formed housing 100 may be a matte surface having a second rugosity.

The first and second rugosities may be either same or different, which may be determined based on design requirements of the housing 100.

The surfaces with the first and second rugosities may be formed by texturing. Specifically, a specific die cleaning solution may be utilized to clean the first die cavity 210 and the outer side wall 230 of the second die cavity 220 so as to remove oil and impurities on the surface of the die. Then, proof fabrics may be attached to the surfaces which do not need texturing, and the boundary between the regions which need texturing and the regions which do not need texturing may be sealed. A sequence of operations such as film printing down, film attaching, painting, corrosion, cleaning and post-processing may then be performed to form the matte surface having a certain rugosity on the outer side walls of the first die cavity 210 and the second die cavity 220.

In some embodiments, the first and second rugosities may be the same, which may facilitate the film printing down process.

In other embodiments, referring to FGIS. 5 and 13, the outer side wall of the first die cavity 210 of the forming die 220 may include a polished surface. This polished surface may be located on at least one side of the surface having the first rugosity. An end of the outer side wall of the first die cavity 210 away from the second die cavity 220 may not be arranged with a polished surface.

This polished surface may be around three sides, on two opposite sides, or only on one side of the surface having the first rugosity, which is not limited in the present embodiment.

In some embodiments, the inner side wall 240 of the forming die 200 may be a polished surface. That is, the inner side walls of the first die cavity 210 and the second die cavity 220 may both be a polished surface such that the entire inner surface of the formed housing 100 may be a polished surface.

In some embodiments, the forming die 200 may include a first die 250 and a second die 260. When the first die 250 is flush with the second die 260, the first die cavity 210 and the second die cavity 220 communicating with each other may be formed. After injection, the first die 250 and the second die 260 may be moved away from each other such that the housing 100 may be separated from the forming die 200.

In other embodiments, it is possible to move only one of the dies to demold. For example, the first die 250 may be fixed and the second die 260 may be moved away from the first die 250. Alternatively, the second die 260 may be fixed and the first die 250 may be moved away from the second die 260.

Those of ordinary skill in the art should understand, in the present disclosure, the nozzle 10 and the liquid storage pipe 20 are an integrated structure made of a same material, and the surface rugosity of the housing 100 may be achieved by controlling the surface rugosity of the forming die 200 such that different portions may have different light transmittances. Therefore, only one injection process is needed to manufacture the housing 100, which may simplify the manufacturing process and augment productivity.

The foregoing is merely embodiments of the present disclosure and is not intended to limit the scope of the disclosure. Any transformation of equivalent structure or equivalent process which uses the specification and the accompanying drawings of the present disclosure, or directly or indirectly application in other related technical fields, are likewise included within the scope of the protection of the present disclosure.

What is claimed is:

1. An atomizer, comprising:

a housing comprising a nozzle and a liquid storage pipe, wherein the nozzle is located at an end of the liquid storage pipe and integrated with the liquid storage pipe, the nozzle and the liquid storage pipe are an integrated structure made of a same material, at least a portion of an outer surface of the nozzle away from the liquid storage pipe comprises a matte surface having a first rugosity, at least a portion of an outer surface of the housing is a polished surface through which aerosol-generating substrate in the liquid storage pipe is observed, and the housing is made of translucent material, a light transmittance of the matte surface ranges from 10% to 80%, and a light transmittance of the polished surface ranges from 30% to 100%; and an atomizing assembly configured to heat and atomize the aerosol-generating substrate to generate aerosol;

wherein the nozzle defines an accommodation cavity inside configured to store aerosol-generating substrate, and the accommodation cavity is in fluid communication with a reservoir of the liquid storage pipe; and the portion of the housing corresponding to the polished surface is thinner than the portion corresponding to the matte surface.

2. The atomizer of claim 1, wherein the entire outer surface of the nozzle is a matte surface having the first rugosity, and at least a portion of an outer surface of the liquid storage pipe is a polished surface.

3. The atomizer of claim 2, wherein the outer surface of the liquid storage pipe comprises at least a first surface and a second surface;

the first surface is arranged between the outer surface of the nozzle and the second surface;

the first surface is a polished surface, and the second surface is a matte surface having a second rugosity.

4. The atomizer of claim 3, wherein the first rugosity is equal to the second rugosity.

5. The atomizer of claim 1, wherein the entire outer surface of the liquid storage pipe is a polished surface.

6. The atomizer of claim 1, wherein the outer surface of the nozzle further comprises a polished surface, the polished surface of the nozzle is arranged on at least one side of the matte surface having a first rugosity, and the polished surface of the nozzle is closer to the liquid storage pipe than the matte surface having a first rugosity.

7. The atomizer of claim 1, wherein the translucent material comprises PCTG.

8. The atomizer of claim 1, wherein the area of a cross-section of the nozzle gradually decreases in a direction away from the liquid storage pipe; and the end of the nozzle away from the liquid storage pile has a rectangular or an oval configuration.

9. The atomizer of claim 8, wherein at a predefined distance from the end of the nozzle away from the liquid storage pipe, a length of the nozzle in a first direction ranges from 17.1 to 26.1 mm, a width of the nozzle in a second direction ranges from 8.1 to 11.3 mm;

a length of the nozzle at the end of the nozzle away from the liquid storage pipe in the first direction ranges from 8.8 to 18.2 mm, and a width of the nozzle at the end of the nozzle away from the liquid storage pipe in the second direction ranges from 4.4 to 7.7 mm;

the first direction is perpendicular to the second direction.

10. The atomizer of claim 9, wherein the predefined distance ranges from 10 to 15 mm.

11. The atomizer of claim 9, wherein the end of the nozzle away from the liquid storage pipe has a rectangular configuration;

at the predefined distance from the end of the nozzle away from the liquid storage pipe, the length of the nozzle in the first direction ranges from 17.1 to 19 mm, the width of the nozzle in the second direction ranges from 8.1 to 9 mm;

the length of the nozzle at the end of the nozzle away from the liquid storage pipe in the first direction ranges from 13 to 17 mm, and the width of the nozzle at the end of the nozzle away from the liquid storage pipe in the second direction ranges from 6 to 7 mm.

12. The atomizer of claim 9, wherein the end of the nozzle away from the liquid storage pipe has an oval configuration;

at the predefined distance from the end of the nozzle away from the liquid storage pipe, the width of the nozzle in the first direction ranges from 19 to 20 mm, the width of the nozzle in the second direction ranges from 9 to 10.5 mm;

the length of the nozzle at the end of the nozzle away from the liquid storage pipe in the first direction ranges from 16.5 to 18.2 mm, and the width of the nozzle at the end of the nozzle away from the liquid storage pipe in the second direction ranges from 6.5 to 7.5 mm.

13. The atomizer of claim 1, wherein the nozzle defines a gas exiting hole at an end away from the liquid storage pipe;

the housing further comprises a gas exiting pipe, the gas exiting pipe is located inside the liquid storage pipe and is connected to a fringe of the gas exiting hole, the gas exiting pipe and the nozzle are formed of a single piece.

14. The atomizer of claim 13, wherein an oleophobic layer is provided on an inner side wall of the gas exiting pipe, to prevent aerosol-generating substrate which has not been vaporized from leaking from the gas exiting pipe.

15. The atomizer of claim 1, wherein an inner surface of the nozzle and an inner surface of the liquid storage pipe are polished surfaces.

16. An electronic atomizing apparatus, comprising:

an atomizer, comprising:

a housing comprising a nozzle and a liquid storage pipe, wherein the nozzle is located at an end of the liquid storage pipe and integrated with the liquid storage pipe, the nozzle and he liquid storage pipe are an integrated structure made of a same material, at least a portion of an outer surface of the nozzle away from the liquid storage pipe comprises a matte surface having a first rugosity, at least a portion of an outer surface of the housing is a polished surface through which aerosol-generating substrate in the liquid storage pipe is observed, and the housing is made of translucent material, a light transmittance of the matte surface ranges from 10% to 80%, and a light transmittance of the polished surface ranges from 30% to 100%;

an atomizing assembly configured to heat and atomize the aerosol-generating substrate to generate aerosol; and a battery assembly connected to the atomizer and configured to power the atomizer;

wherein the nozzle defines an accommodation cavity inside configured to store aerosol-generating substrate, and the accommodation cavity is in fluid communication with a reservoir of the liquid storage pipe; and the portion of the housing corresponding to the polished surface is thinner than the portion corresponding to the matte surface.

* * * * *